US008881886B2

(12) United States Patent
Bruner et al.

(10) Patent No.: US 8,881,886 B2
(45) Date of Patent: Nov. 11, 2014

(54) COIN ACCEPTOR WITH ANTI-FRAUD FEATURE

(71) Applicants: Philemon L. Bruner, Katy, TX (US); Kurt D. Regenbrecht, Hallettsville, TX (US)

(72) Inventors: Philemon L. Bruner, Katy, TX (US); Kurt D. Regenbrecht, Hallettsville, TX (US)

(73) Assignee: Imonex Services, Inc., Sealy, TX (US)

( * ) Notice: Subject to any disclaimer, the term of this patent is extended or adjusted under 35 U.S.C. 154(b) by 0 days.

(21) Appl. No.: 13/718,352

(22) Filed: Dec. 18, 2012

(65) Prior Publication Data

US 2014/0166431 A1 Jun. 19, 2014

(51) Int. Cl.
*G07F 1/04* (2006.01)
*G07D 11/00* (2006.01)

(52) U.S. Cl.
CPC ..... *G07D 11/0018* (2013.01); *G07F 1/041* (2013.01)
USPC ..... 194/202

(58) Field of Classification Search
CPC .... G07D 11/00; G07D 11/00018; G07F 1/00; G07F 1/02; G07F 1/04; G07F 1/041; G07F 1/046
USPC ..... 194/202, 351, 344, 349; 232/4 R, 7, 9, 232/12, 14, 44, 55; 193/DIG. 1
See application file for complete search history.

(56) References Cited

U.S. PATENT DOCUMENTS

| | | | | |
|---|---|---|---|---|
| 4,911,280 | A | 3/1990 | Bruner | |
| 5,279,404 | A | 1/1994 | Bruner et al. | |
| 5,634,544 | A | 6/1997 | Bruner et al. | |
| 5,647,470 | A * | 7/1997 | Bruner et al. | 194/347 |
| 5,738,200 | A | 4/1998 | Bruner | |
| 5,988,349 | A | 11/1999 | Bruner et al. | |
| 6,039,165 | A * | 3/2000 | Wild | 194/217 |
| 6,053,463 | A | 4/2000 | Melvin | |
| 6,155,399 | A | 12/2000 | Bruner | |
| 7,635,059 | B1 | 12/2009 | Bruner et al. | |
| 2001/0015312 | A1 | 8/2001 | Bruner | |
| 2010/0066490 | A1 | 3/2010 | Bruner et al. | |

* cited by examiner

*Primary Examiner* — Mark Beauchaine
(74) *Attorney, Agent, or Firm* — Duane Morris LLP

(57) ABSTRACT

A method and apparatus for preventing the fraudulent receipt of credit for the goods or services provided by a coin-operated device is disclosed. A coin acceptor with an anti-fraud feature comprises a coin-accept channel comprising a lip to block the introduction of a non-coin object to a coin sensor and a coin-guiding surface to guide a coin downstream the lip to the coin sensor. The coin-accept channel may further comprise a blocking area, a deflection surface, and a protrusion to prevent the upstream movement of a tethered coin-like object, thereby preventing a single tethered coin-like object from receiving multiple credits for the goods or services provided by a coin-operated device.

10 Claims, 13 Drawing Sheets

COIN ACCEPTOR WITH ANTI-FRAUD FEATURE

BACKGROUND

The present invention relates generally to coin acceptor apparatuses for coin-operated devices, including vending machines, telephones, video game machines or other applications which implement mechanical sorting, selection, rejection and crediting of coins. More specifically, the present invention is directed to a coin acceptor apparatus with an anti-fraud feature to reduce fraudulent access to goods or services provided by a coin-operated device.

Many times, the principal design feature of coin acceptor apparatuses is to limit the operations of a device to a particular denomination of coin, as dictated by the price of the merchandise, service or entertainment available through the device. Other times, a principal desire is to limit the size of the machine as dictated by space concerns. There is generally very limited space in most devices for a coin acceptor; and this is especially the case when the acceptor must be capable of accepting a variety of denominations. Further, it is desirable to reduce malfunction of the coin acceptor apparatus, thereby reducing lost revenues from down-time and the costs associated with repairing the apparatus.

A coin-acceptor apparatus is sometimes susceptible to the use of fraudulent means and methods for improperly obtaining access to the goods or services provided by the coin-operated device in which the coin-acceptor is installed. For example, it has become commonplace for individuals to attempt to force a non-coin object, e.g., a wire, a coat hanger, or the underwire from a woman's brassiere, into a coin inlet of coin-operated devices in an attempt to induce a coin sensor into crediting the deposition of proper coinage. It is also common for individuals to attempt to use a coin or a coin-like object attached to a tether, e.g. a string, tape, which is inserted into the coin inlet to obtain a value register of the value of coins where the coinage is subsequently withdrawn.

Attempts to prevent this fraudulent procurement of goods and services include the use of a coin acceptor apparatus comprising a moving lever to mechanically block a non-coin object or a tether. However, several problems exist with the use of a moving lever. For example, for proper functioning of the lever, oftentimes the coin-acceptor must be kept level, which places many restrictions on its installation location. Additionally, a coin-acceptor with a moving lever is susceptible to malfunction because sufficient time must pass between introduction of each coin introduced to the apparatus to prevent jamming of multiple coins. The lever must assume a starting position after each coin passes or the coins will begin to stack on top of one another and the apparatus will jam. This may lead to down-time and a resultant loss of revenues during the time the device is out-of-service and additional lost revenues for repair expenses.

DETAILED DESCRIPTION OF THE INVENTION

Figure 1:
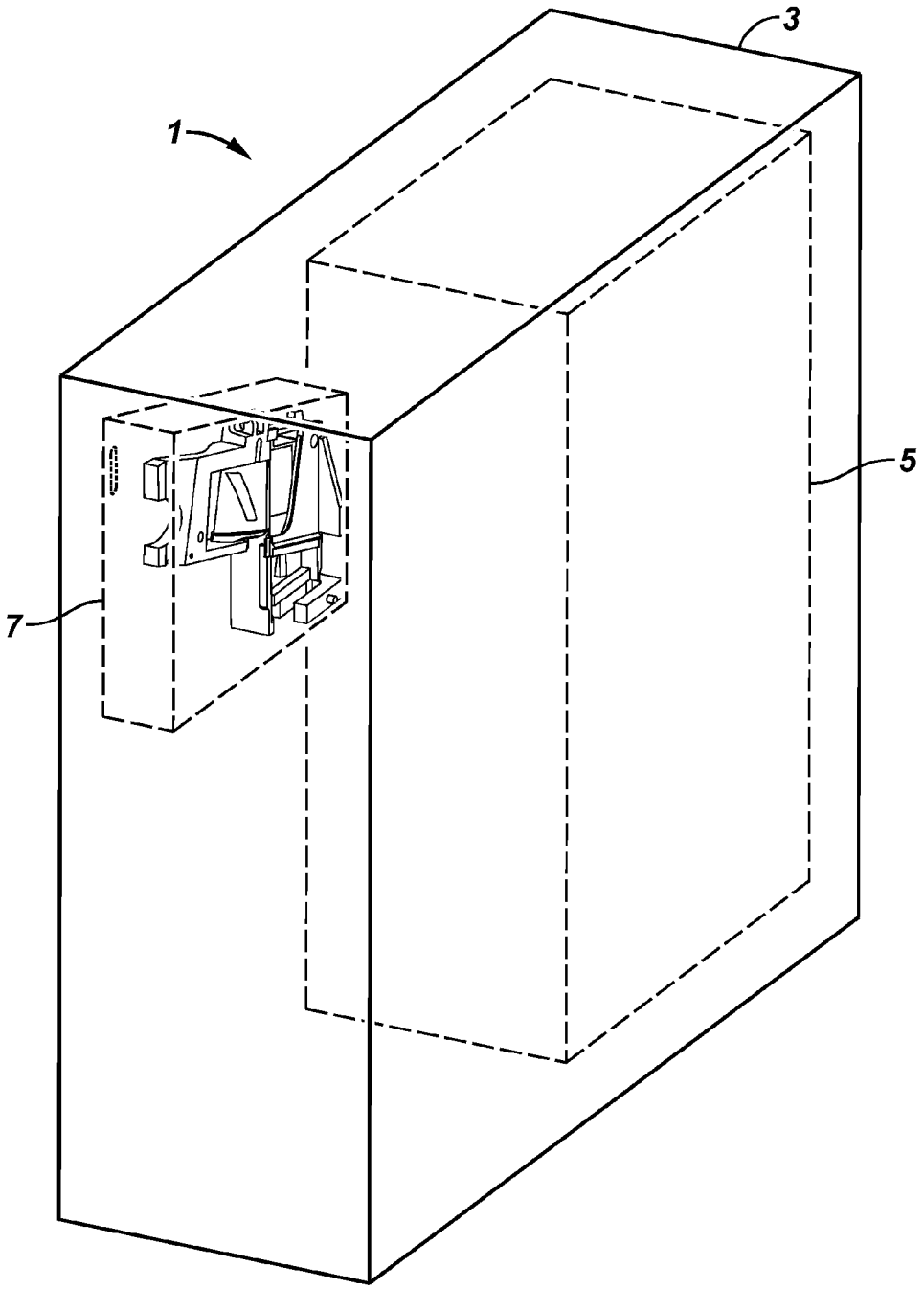
FIG. 1 is a block diagram of an apparatus comprising a housing containing a coin-operated device and a coin acceptor of one embodiment of the invention.

Embodiments of the invention incorporate an anti-fraud feature to prevent the fraudulent procurement of goods and services provided by a coin-operated device. Specifically, embodiments of the invention prevent the use of a non-coin object and/or a tethered coin-like object to fraudulently receive credit for the goods or services provided by a coin-operated device. In one embodiment, an apparatus 1 comprises a housing 3 containing a coin-operated device 5 and a coin acceptor 7 coupled to housing 3 to accept coins to operate coin-operated device 5 as may be seen with reference to FIG. 1.

Figure 2:
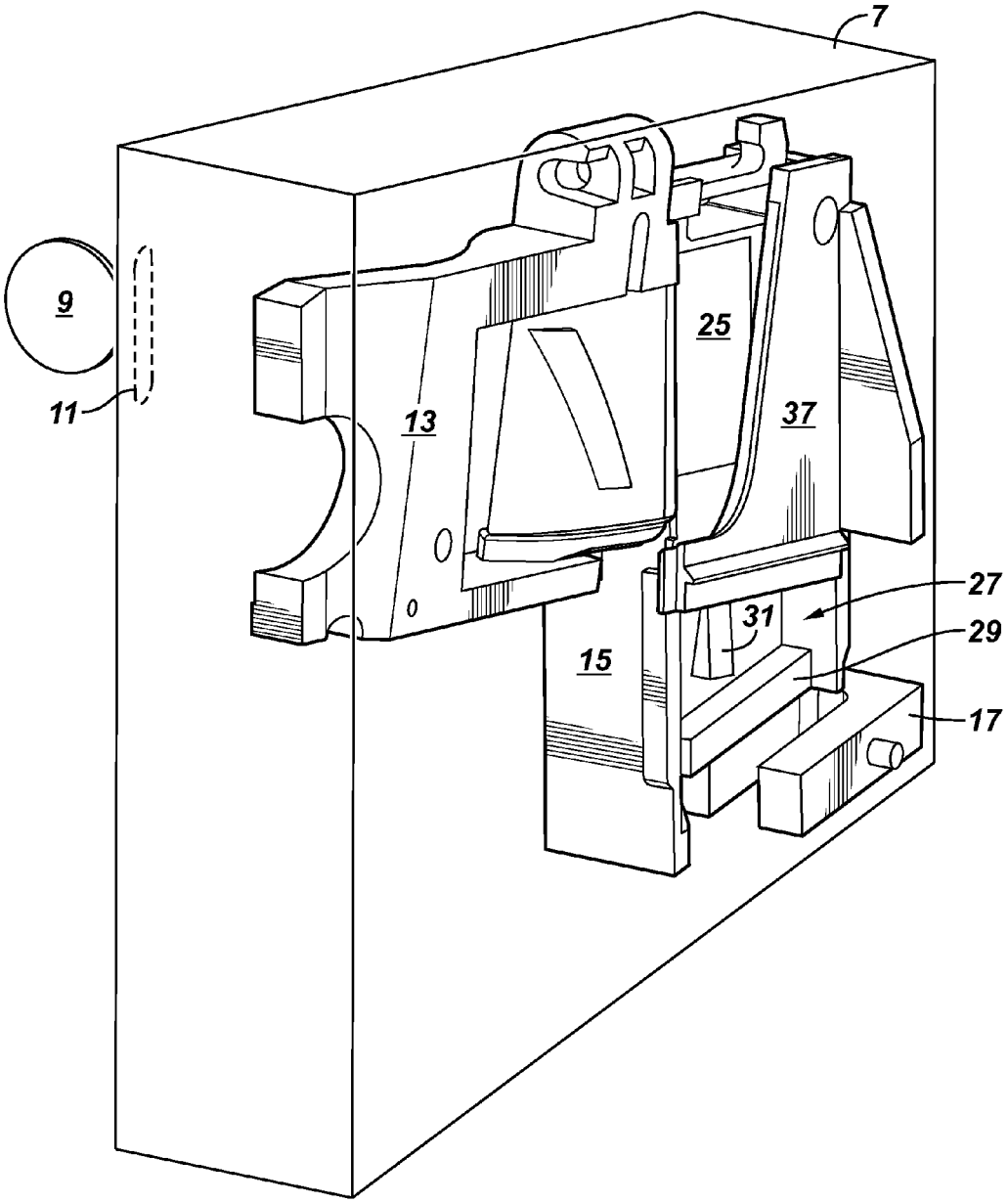
FIG. 2 is a perspective, cut-away view of a coin acceptor with an exemplary anti-fraud feature, in accordance with an embodiment.
Figure 8:
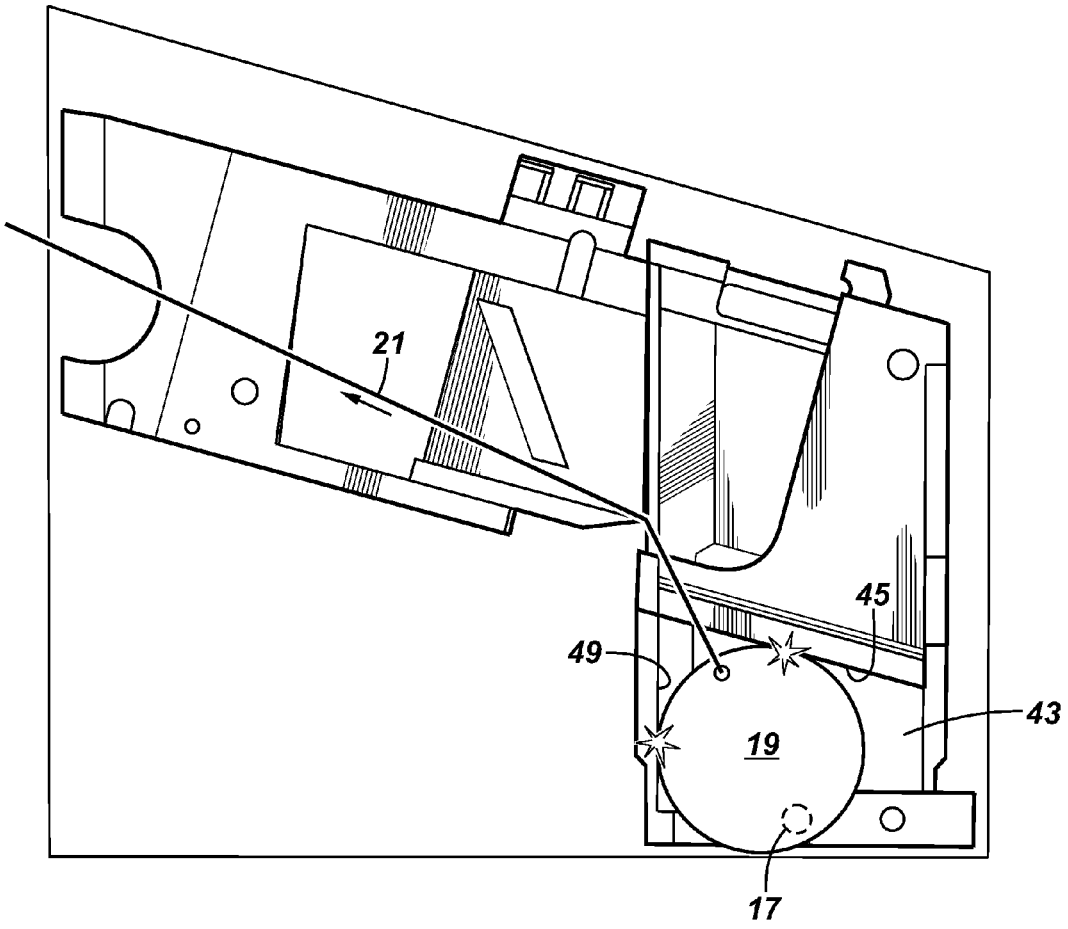
FIG. 8 is an illustration of an exemplary anti-fraud feature of the embodiment illustrated in FIG. 2.

Referring to FIG. 2, a coin 9 introduced into a coin inlet 11 travels along a coin race 13 to a coin-accept channel 15 wherein the coin is guided to a coin sensor 17 to be detected and credited to obtain goods or services provided by a coin operated device. In an effort to receive goods or services provided by coin-operated devices fraudulently, individuals may use a non-coin object 23, e.g. a wire, a coat hanger, an underwire from a woman's brassiere, in an attempt to induce coin sensor 17 into crediting the deposition of proper coinage. This technique may be referred to as "wire-fraud." Alternatively, an individual may utilize a coin or a coin-like object attached to a tether, e.g., string, tape, to obtain a value register of the value of coins where the coinage is subsequently withdrawn. This technique is often referred to as "stringing." Specifically, as depicted in FIG. 8, a tethered coin-like object 19 may be inserted into coin inlet 11, travel on coin race 13, and on coin-accept channel 15 to coin sensor 17. After coin sensor 17 credits the deposition of coinage, a thief may place an upstream force upon a tether 21 of the tethered coin-like object 19 so as to remove tethered coin-like object 19 from coin sensor 17.

Figure 6:
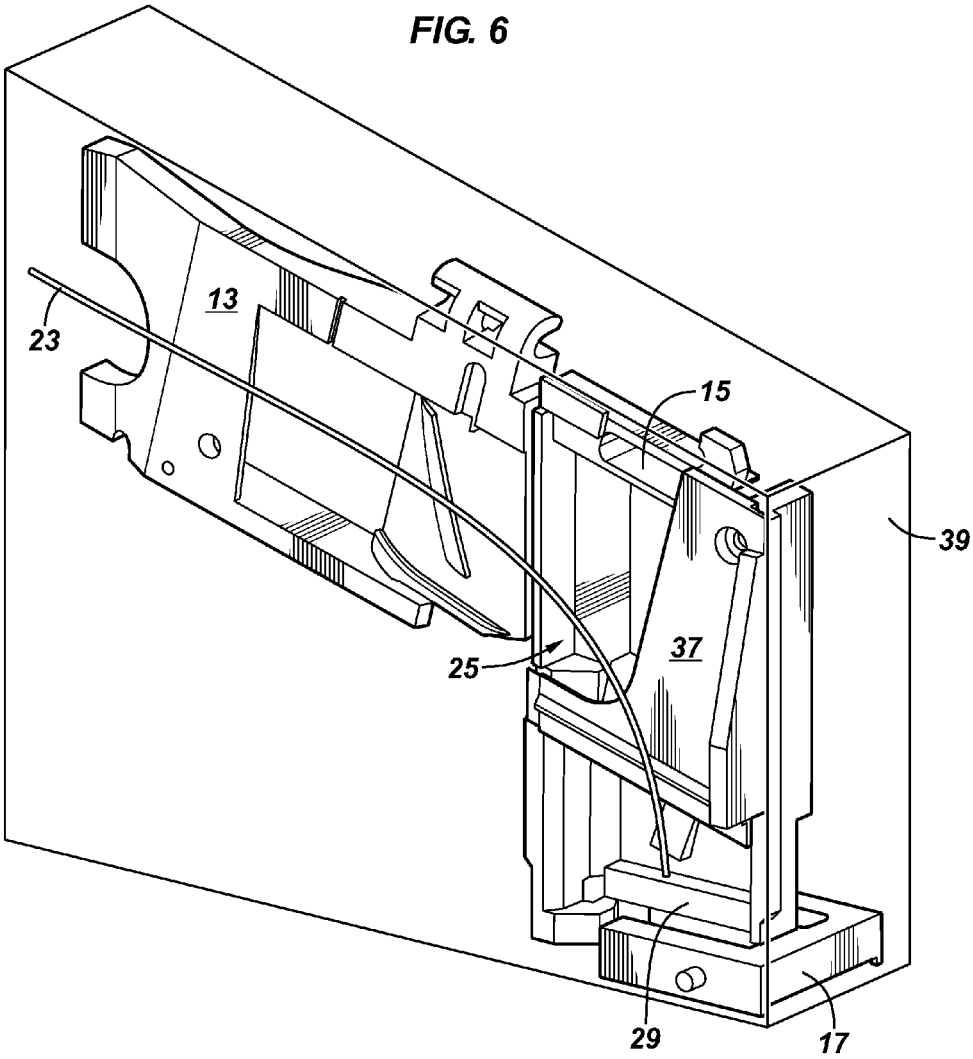
FIG. 6 is an opposite perspective view of the exemplary embodiment illustrated in FIG. 2.

To prevent fraudulent receipt of credit for the goods or services provided by a coin-operated device, various embodiments of the invention provide a method and apparatus to guide coin 9 received in coin acceptor 7 for a coin-operated device to coin sensor 17, detect an eclipse of coin sensor 17 by coin 9, detect an opening of coin sensor 17 once coin 9 travels downstream from coin sensor 17, credit proper coinage for use of the coin-operated device once coin sensor 17 is eclipsed and subsequently opened, and block the introduction of non-coin object 23 to coin-sensor 17 as depicted in FIG. 6.

As illustrated in FIG. 2, to prevent fraudulent receipt of credit for use of the coin-operated device by "wire fraud", an apparatus for use with a coin-operated device comprises at least one coin-accept channel 15 comprising a coin entrance portion 25 and a coin exit portion 27 downstream from coin entrance portion 25, wherein coin exit portion 27 comprises a lip 29 upstream from coin sensor 17, wherein lip 29 obstructs passage of non-coin object 23 (FIG. 6) through coin-accept channel 15 to prevent the eclipse of coin sensor 17 by non-coin object 23; and the at least one coin-accept channel 15 comprises a coin-guiding surface 31 upstream from lip 29 to guide a coin past lip 29 toward coin sensor 17.

Coin acceptor 7 comprises coin-accept channel 15, which is positioned adjacent to downwardly inclined coin race 13 as depicted in FIG. 2. Coin-entrance portion 25 accepts a coin or a coin-like object proceeding on coin race 13 and guides the coin or coin-like object to coin sensor 17 for detection and for crediting the value of the coinage to obtain goods or services provided by a coin-operated device. Coin sensor 17 is downstream from coin-accept channel 15 and adjacent to coin-exit portion 27 of coin-accept channel 15. Coin-accept channel 15 can be made of a polymer or any other suitable material. In one embodiment, an upstream portion of coin-accept channel 15 comprises a resilient or spring-like mechanism 26, which is configured to facilitate assembly of coin-accept channel 15 with coin acceptor 7. Alternatively, spring-like mechanism 26 allows coin acceptor 7 to be retrofitted more easily with coin-accept channel 15. Spring-like mechanism 26 is an elongate member on the upstream portion of coin-accept channel 15 with at least one portion of spring-like mechanism 26 attached to coin-accept channel 15 by any suitable means of attachment and at least one portion of spring-like mechanism 26 not attached to coin-accept channel 15 such that spring-like mechanism has vertical freedom of movement.

Figure 3:
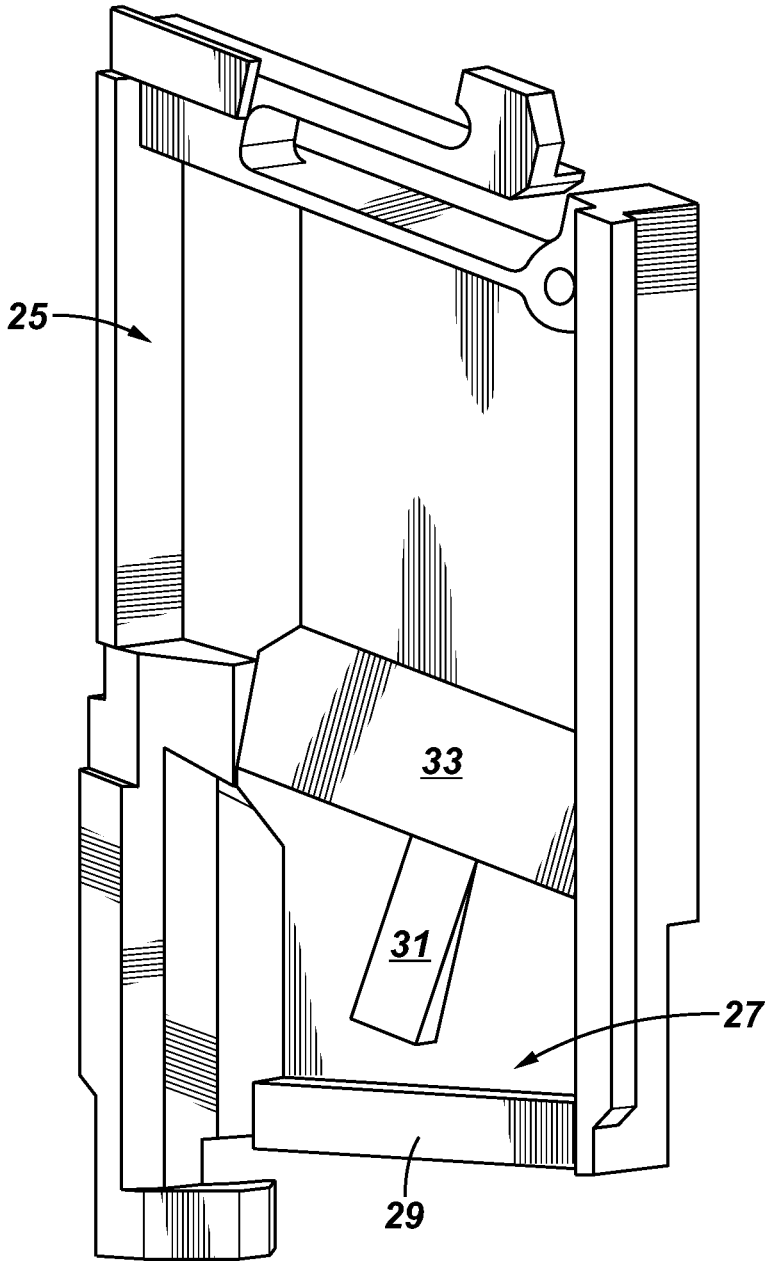
FIG. 3 is a detail, cut away view of an exemplary coin-accept channel of the coin acceptor illustrated in FIG. 2.

In one embodiment, coin exit portion 27 of coin-accept channel 15 comprises lip 29 positioned upstream from coin sensor 17. Referring to FIG. 3, lip 29 is sized and positioned to obstruct the passage of non-coin object 23 through coin-accept channel 15 to coin-sensor 17 to prevent the eclipse of coin sensor 17 by the non-coin object. However, a coin should have freedom to move downstream lip 29 to coin-sensor 17 in order to be properly credited. Therefore, coin-guiding surface 31 is provided to guide the coin past lip 29 to coin-sensor 17. Coin-accept channel 15 may also comprise a ramped surface 33 upstream coin-guiding surface 31 to guide a coin to coin-guiding surface 31 and to coin sensor 17. In one embodiment, ramped surface 33 begins to set the trajectory and momentum of a coin traveling on coin-accept channel 15 before reaching coin-guiding surface 31 to aid the coin in traveling downstream lip 29 to coin-sensor 17 in order to be properly credited. In one embodiment, coin-guiding surface 31 is a ramp. In another embodiment, coin-guiding surface 31 is arcuate. Because ramped surface 33 begins to set the trajectory and momentum of a coin traveling on coin-accept channel 15 before the coin travels to coin-guiding surface 31, the coin-guiding surface 31 may extend a smaller distance from coin-accept channel 15 than does lip 29. Coin-guiding surface 31 may be positioned on coin-accept channel 15 at an angle to lip 29. Specifically, coin-guiding surface 31 may be in a non-perpendicular orientation in relation to lip 29. This orientation facilitates a side of coin-guiding surface 31 to block the passage of a non-coin object through coin-accept channel 15 to coin-sensor 17 to prevent the eclipse of coin sensor 17 by non-coin object. Other shaped surfaces, suitable structures and spatial juxtapositions are contemplated within the spirit of the invention.

Figure 4:
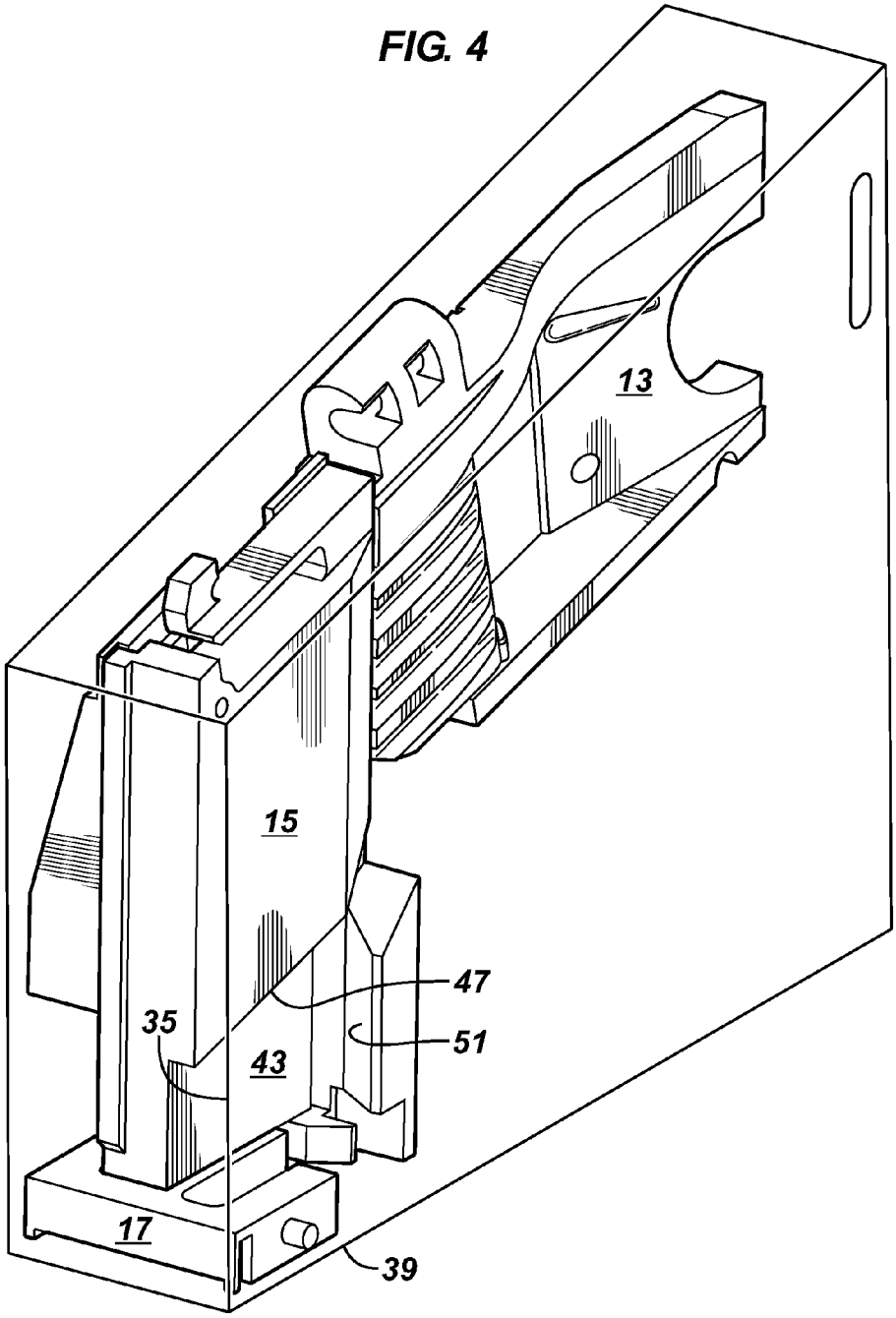
FIG. 4 is an opposite side, perspective view of the exemplary embodiment illustrated in FIG. 2.
Figure 5:
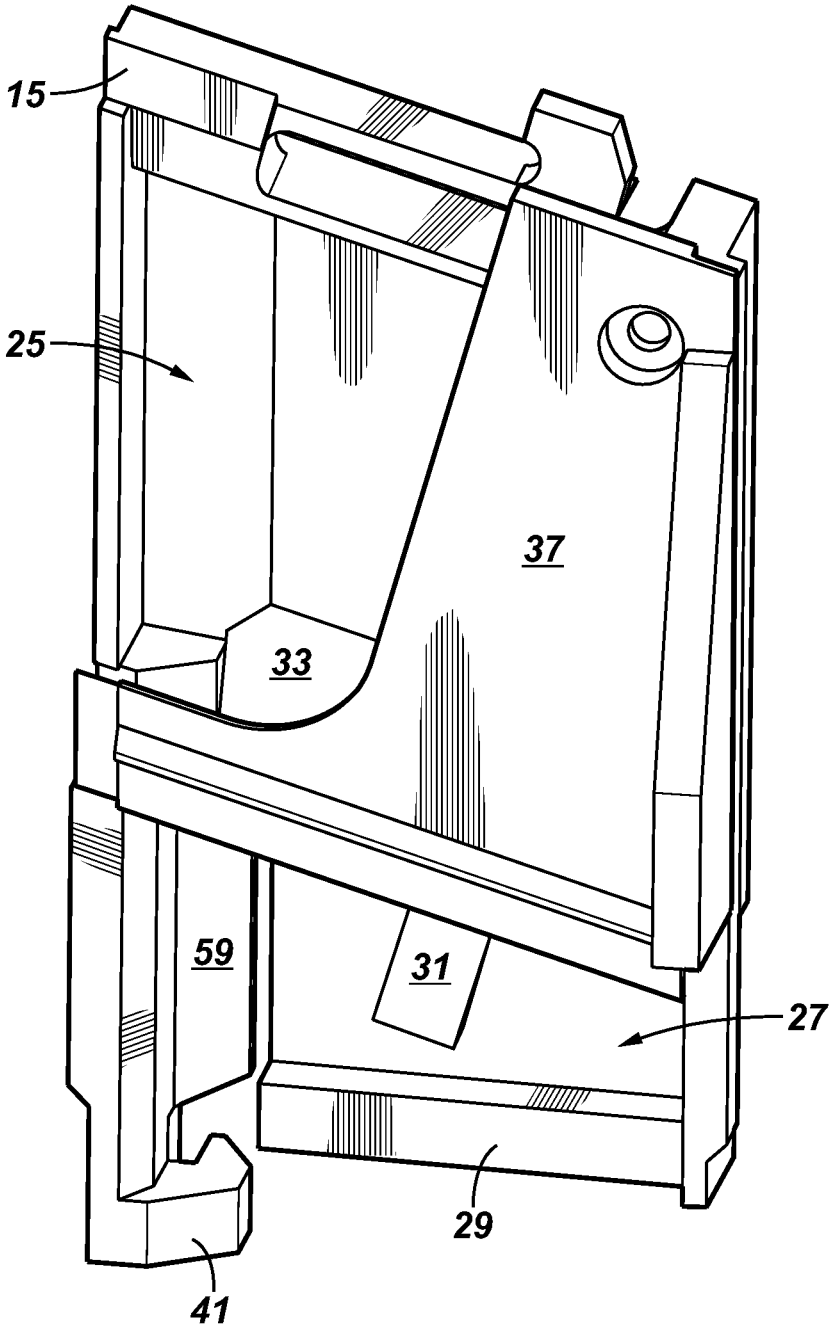
FIG. 5 is perspective view of an exemplary coin-accept channel with a wall.

Referring to FIG. 2 and FIG. 4, one embodiment comprises a wall (35, 37) adjacent to coin-accept channel 15, wherein the wall creates a confined space in which a coin is guided downstream coin-accept channel 15 to coin-sensor 17 and a non-coin object is blocked from moving downstream to coin-sensor 17. In one embodiment, wall 35 comprises an interior portion of a housing 39 for coin-accept channel 15 as depicted in FIG. 4. Referring to FIGS. 5 and 6, in another embodiment the wall 37 is attached to coin-accept channel 15 and is adjacent to a housing 39 for coin-accept channel 15. Wall 37 may be affixed to coin-accept channel 15 by fastening means, such as a screw. Alternatively, wall 37 may be formed with coin-accept channel 15 as a unitary piece. Coin-accept channel 15, wall 35 and wall 37 may be made out of a polymer or any other suitable material.

Figure 7:
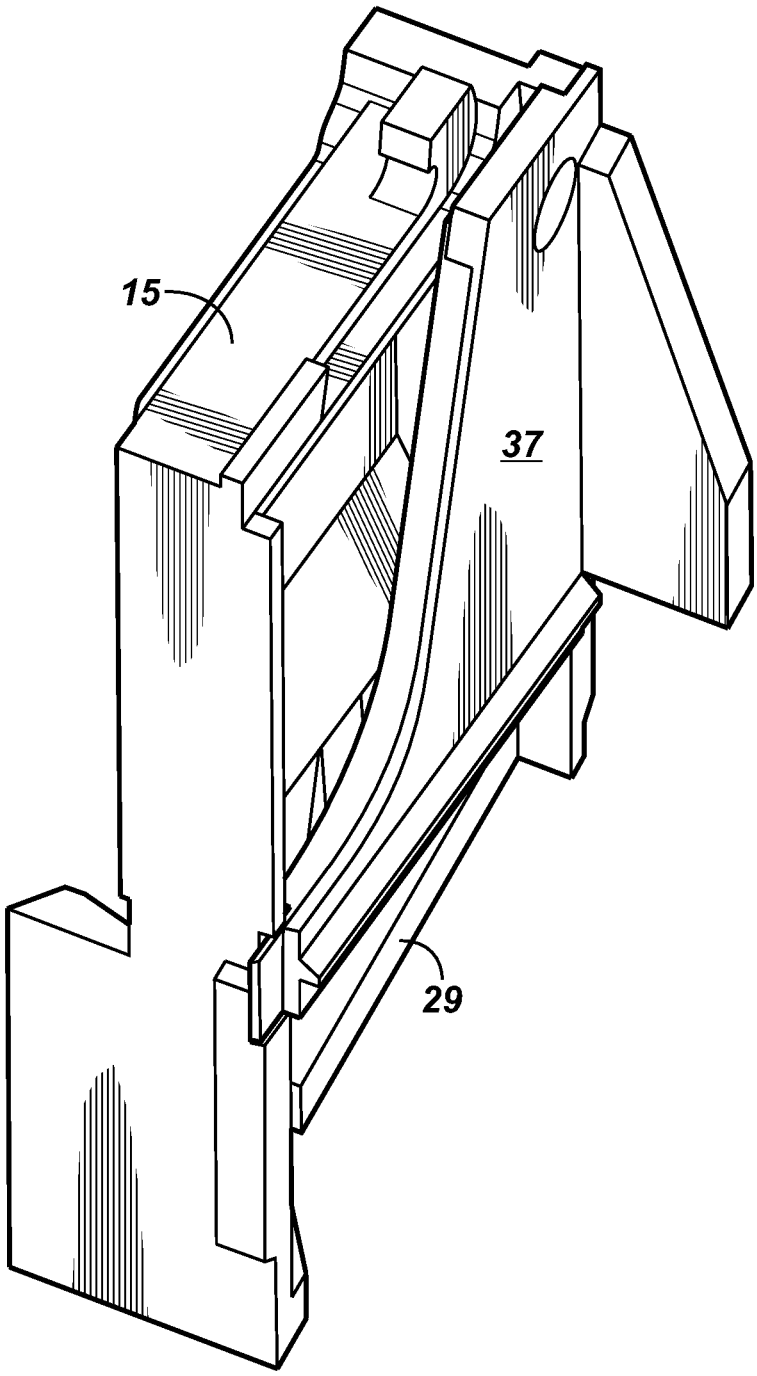
FIG. 7 is top-side perspective view of an exemplary coin-accept channel of the embodiment illustrated in FIG. 2.

As depicted in FIG. 6, a non-coin object 23, e.g., a wire, a coat hanger, an underwire from a woman's brassiere, introduced to coin inlet 11 will proceed on coin race 13 to coin entrance portion 25 of coin-accept channel 15. Coin-accept channel 15 prevents non-coin object 23 from moving downstream coin-accept channel 15 to coin sensor 17 regardless of the force placed on non-coin object 23. For example, if a generally downstream force is placed on non-coin object 23, non-coin object 23 will hit at least one of a multitude of obstructions, including lip 29, ramped surface 33, wall 37, or coin-guiding surface 31 as depicted in FIG. 2 and in detail in FIG. 5 and will be blocked from traveling downstream coin-accept channel 15 to coin sensor 17. Referring to FIGS. 6 and 7, wall 37 is positioned in relation to lip 29, coin sensor 17, and housing 39 so that non-coin object 23 is prevented from traveling to coin sensor 17 regardless of the direction of the force placed on non-coin object 23.

In one embodiment, coin acceptor 7 comprises coin sensor 17, wherein coin sensor 17 is configured such that credit for deposition of proper coinage is given only upon a coin traveling through coin sensor 17 such that coin sensor 17 is eclipsed and subsequently open. Only once the coin travels downstream coin sensor 17, will credit be given for deposition of coinage. Thus, by preventing tethered coin-like object 19 from a) moving upstream from coin sensor 17 subsequent to coin sensor 17 being eclipsed (depicted in FIG. 8), and b) moving upstream to coin sensor 17 subsequent to tethered coin-like object 19 moving downstream coin sensor 17 and coin sensor 17 opening (depicted in FIG. 9), fraudulent procurement of goods or services provided by a coin-operated device by the fraudulent means and methods of "stringing" may be prevented.

Accordingly, an apparatus and method is provided to guide tethered coin-like object 19 received in coin acceptor 7 for a coin-operated device to coin sensor 17, detect an eclipse of coin sensor 17 by tethered coin-like object 19, block upstream movement of tethered coin-like object 19 once tethered coin-like object 19 eclipses coin sensor 17, detect the opening of coin sensor 17 once tethered coin-like object 19 travels downstream from coin sensor 17, and guide tethered coin-like object 19 downstream a protrusion 41 once tethered coin-like object 19 travels downstream coin sensor 17, wherein protrusion 41 is positioned to capture tether 21 of tethered coin-like object 19 and to block upstream movement of tethered coin-like object 19 to prevent eclipse of coin sensor 17 by upstream movement. This may better be understood by reference to FIGS. 8 and 9.

Tethered coin or coin-like object 19 follows the same path through coin acceptor 7 as described above for a coin not so attached. However, after traveling downstream lip 29, coin-accept channel 15 prevents tethered coin-like object 19 from moving upstream from coin sensor 17 regardless of the forces placed on tethered coin-like object 19. In one embodiment, an apparatus for use with a coin operated device comprises at least one coin-accept channel 15 and at least one coin sensor 17 adjacent to a downstream portion of the at least one coin-accept channel 15, the at least one coin accept channel 15 comprises coin entrance portion 25 and coin exit portion 27 downstream from coin entrance portion 25, wherein coin exit portion 27 comprises a blocking area 43 to prevent upstream movement of tethered coin-like object 19 received by coin-accept channel 15 subsequent to an eclipse of coin sensor 17 by tethered coin-like object 19, wherein blocking area 43 comprises a first contact edge (45, 47) traversing coin-accept channel 15 and a second contact edge (49, 51) adjacent to first contact edge (45, 47) to block upstream movement of tethered coin-like object 19 away from coin sensor 17.

Figure 9:
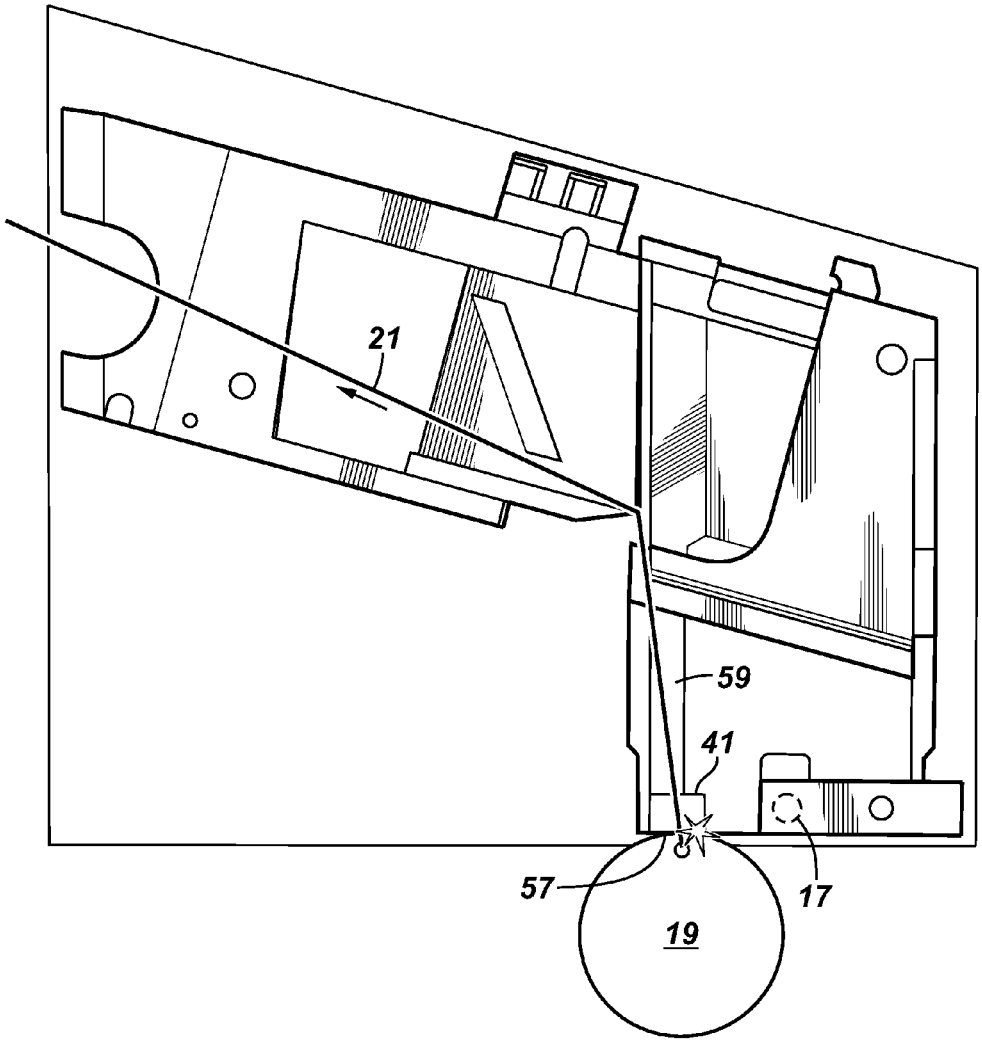
FIG. 9 is an illustration of an exemplary anti-fraud feature of the embodiment illustrated in FIG. 2.
Figure 10:
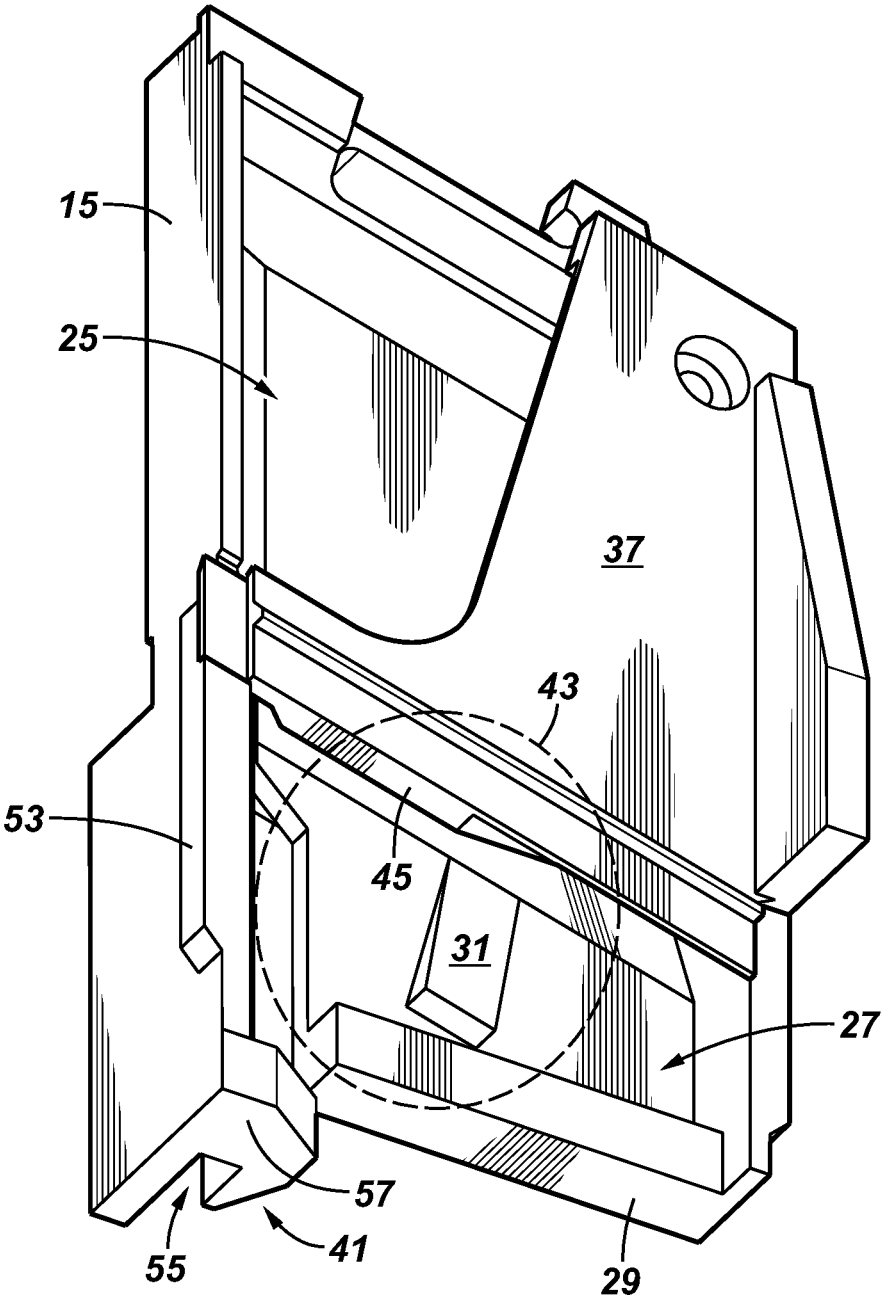
FIG. 10 is a detail, cut-away view of an exemplary blocking area of the embodiment illustrated in FIG. 2.
Figure 11:
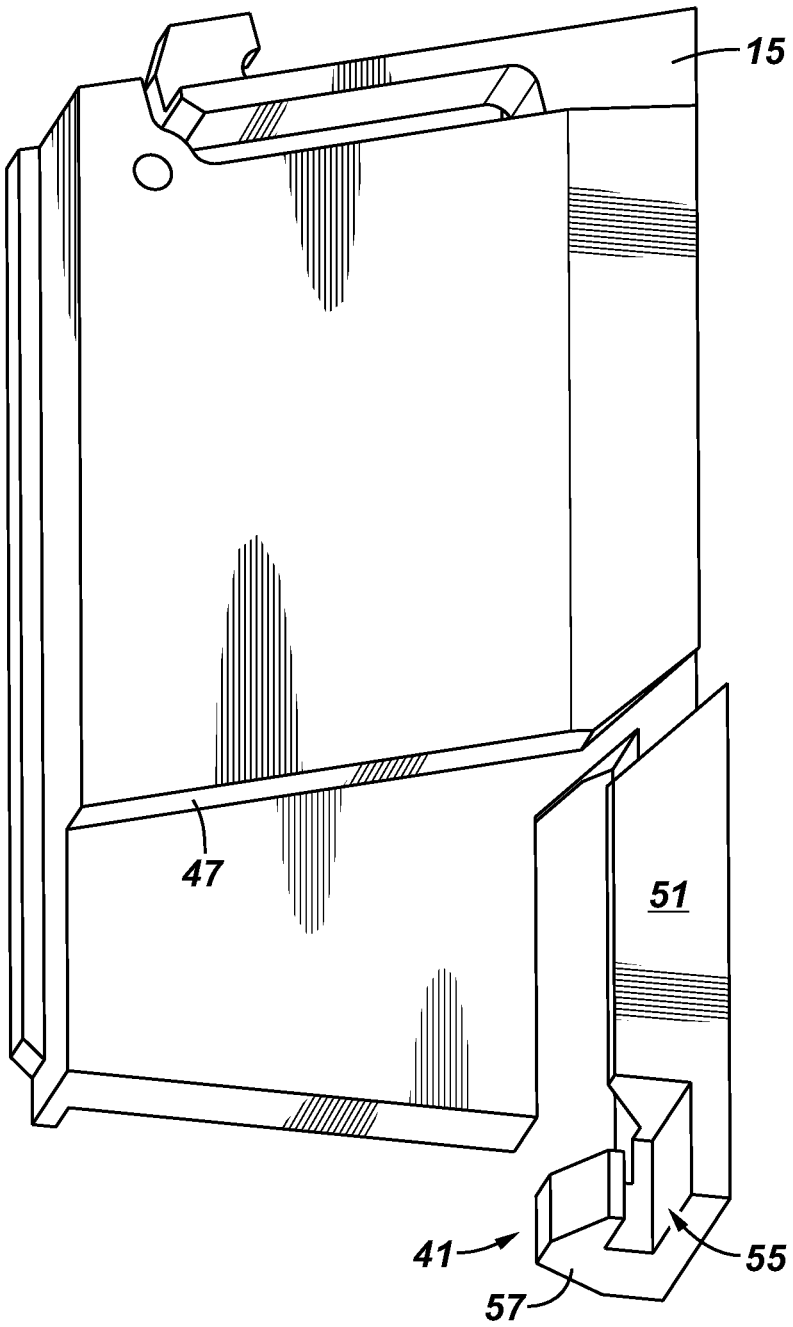
FIG. 11 is an illustration of another exemplary embodiment of a blocking area.

When a force is placed on tethered coin-like object 19 via tether 21 subsequent to tethered coin-like object 19 traveling on coin-accept channel 15 to coin sensor 17, blocking area 43 prevents tethered coin-like object 19 from moving upstream coin sensor 17 and thereby restricts tethered coin-like object 19 to a position continuously eclipsing coin sensor 17 so that no credit is given for the value of the coinage as depicted in FIG. 8. Referring to FIGS. 9 and 10, in one embodiment first contact edge 45 is a downstream portion of wall 37 attached to coin-accept channel 15. In another embodiment, first contact edge 47 is a ledge traversing coin accept channel 15 as may be seen in FIG. 4 and FIG. 11. Second contact edge 49 is positioned on a forward edge 53 of coin-accept channel 15 and is adjacent to first contact edge 45 such that upstream movement of tethered coin-like object 19 is prevented and tethered coin-like object 19 continuously eclipses coin sensor 17 if an upstream force is placed on tethered coin-like object 19. Similarly, second contact edge 51 is positioned adjacent to first contact edge 47 such that upstream movement of tethered coin-like object 19 is prevented and tethered coin-like object 19 continuously eclipses coin sensor 17 if an upstream force is placed on tethered coin-like object 19.

Figure 12:
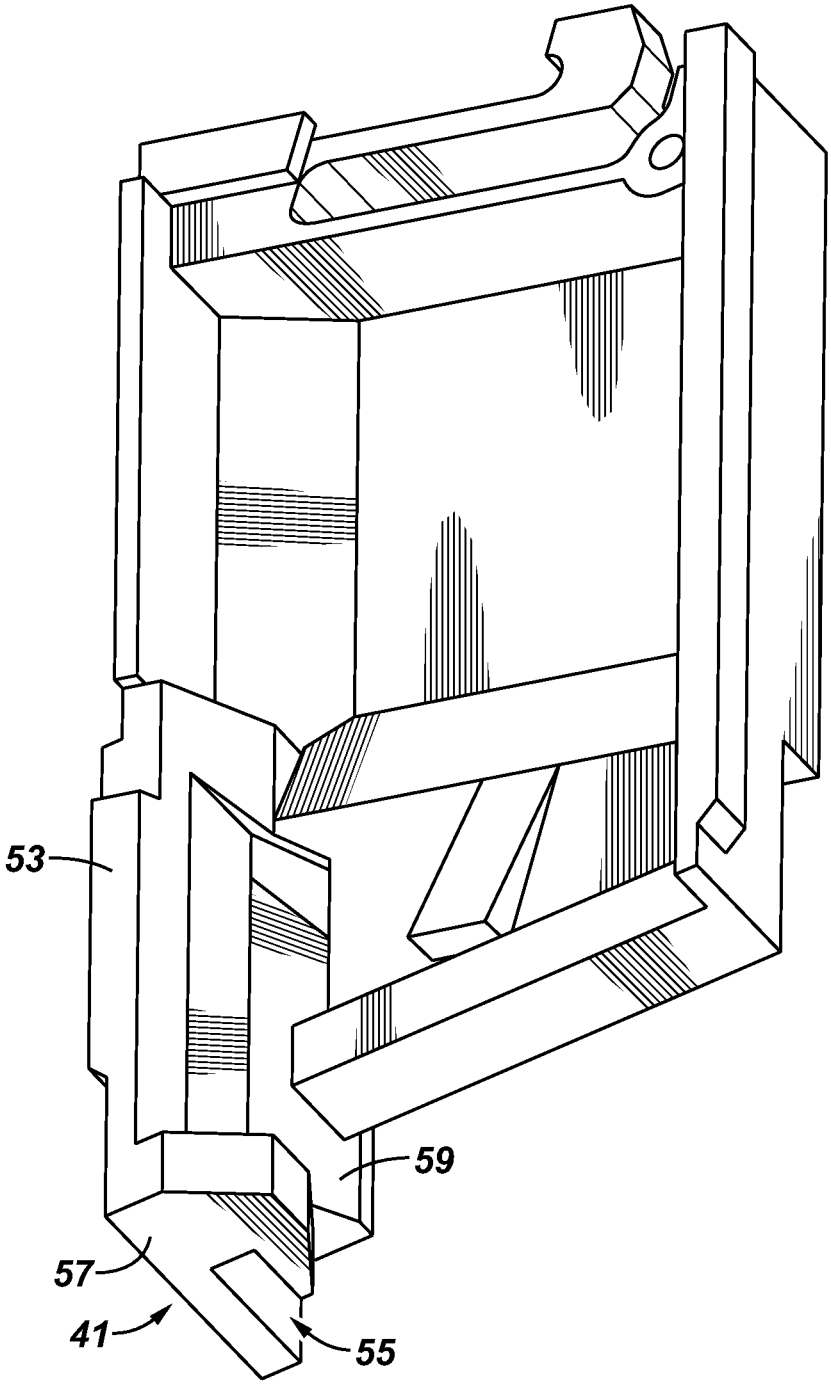
FIG. 12 is a detail, cut-away view of an exemplary "anti-stringing" feature of the embodiment illustrated in FIG. 2.

Referring to FIG. 9, if no upstream force is placed on tethered coin-like object 19, tethered coin-like object 19 travels downstream coin sensor 17 due to gravitational forces and coin sensor 17 opens thereby crediting deposition of proper coinage. If an upstream force is subsequently placed on tethered coin-like object 19, coin-accept channel 15 prevents more than one eclipse of coin sensor 17 by the same tethered coin-like object 19, thereby preventing fraudulent receipt of credit for the goods or services provided by a coin-operated device. Referring to FIG. 9 and FIG. 12, one embodiment comprises an apparatus for use with a coin-operated device comprising at least one coin-accept channel 15 and at least one coin sensor 17 adjacent to a downstream portion of the at least one coin accept channel 15, the at least one coin accept channel 15 comprises coin entrance portion 25, coin exit portion 27 downstream from coin entrance portion 25 and forward edge 53 extending from coin entrance portion 25 downstream to coin exit portion 27, wherein forward edge 53 comprises protrusion 41 comprising an aperture 55 for receiving tether 21 of tethered coin-like object 19 received by coin-accept channel 15, and a blocking surface 57 downstream from coin sensor 17; and a deflection surface 59 adjacent to protrusion 41 to guide tether 21 of tethered coin-like object 19 to aperture 55 and to position tethered coin-like object 19 downstream from blocking surface 57, wherein blocking surface 57 blocks upstream movement to coin sensor 17 by tethered coin-like object 19.

Figure 13:
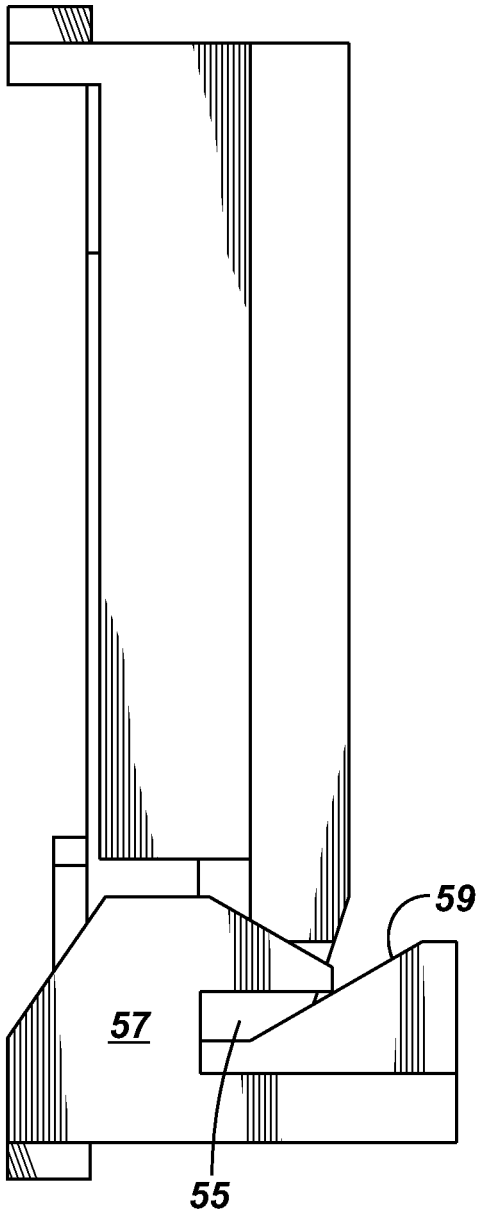
FIG. 13 is a bottom perspective view of the exemplary "anti-stringing" feature of the embodiment illustrated in FIG. 2.

Once tethered coin-like object 19 travels downstream coin sensor 17, deflection surface 59 guides tether 21 to aperture 55 of adjacent protrusion 41. As depicted in FIG. 9, deflection surface 59 may be angled, arcuate, or any other suitably shaped surface for guiding tether 21 to aperture 55 of protrusion 41. Referring to FIG. 12, protrusion 41 may also be situated on forward edge 53 of coin-accept channel 15. Protrusion 41 comprises aperture 55 for receiving tether 21 of tethered coin-like object 19. Aperture 55 may be of any configuration, including a u-shape with an opening oriented toward deflection surface 59, which is suitable for receiving tether 21 and restricting the movement of tether 21. FIG. 13 depicts one embodiment of the spatial juxtaposition between aperture 55 and deflection surface 59. Protrusion 41 also comprises blocking surface 57 positioned downstream coin sensor 17. Aperture 55 restricts the movement of tether 21 such that tethered coin-like object 19 is positioned downstream blocking surface 57. If an upstream force is placed on tethered coin-like object 19, tethered coin-like object 19 is prevented from moving upstream to coin sensor 17 and eclipsing coin sensor 17 more than once. Other spatial juxtapositions and structures are also contemplated within the spirit and scope of the invention.

In one embodiment, blocking area 43, deflection surface 59 and protrusion 41 prevent receipt of more than one credit by a single tethered coin-like object 19 by preventing more than one eclipse and opening of coin sensor 17 by a single tethered coin-like object 19. Blocking area 43 prevents upstream movement of tethered coin-like object 19 subsequent to an eclipse of coin-sensor 17, and deflection surface 59 and protrusion 41 prevent upstream movement to coin sensor 17 subsequent to receipt of credit for the eclipse and opening of coin sensor 17 to prevent a single tethered coin-like object 19 from inducing receipt of more than one credit.

In another embodiment, fraudulent procurement of credit for the goods or services of a coin-operated device by both "wire-fraud" or "stringing" is prevented by an apparatus comprising coin-accept channel 15 comprising lip 29, coin-guiding surface 31, wall 37, deflection surface 59, and protrusion 41 comprising aperture 55 and blocking surface 57.

Although particular detailed embodiments of the apparatus have been described herein, it should be understood that the invention is not restricted to the details of the embodiments. Many changes in design, composition, configuration and dimensions are possible without departing from the spirit and scope of the instant invention. Accordingly, it should be readily understood that the embodiments described and illustrated herein are illustrative only, and are not to be considered as limitations upon the scope of the present invention.

What is claimed is:

1. An apparatus for use with a coin-operated device, comprising:

at least one coin-accept channel comprising a coin entrance portion and a coin exit portion downstream from said coin entrance portion, wherein said coin exit portion comprises a lip extending into the coin accept channel upstream from a coin sensor, said lip having a top surface substantially normal to a portion of the coin accept channel, wherein said lip obstructs passage of a non-coin object through the coin-accept channel to prevent the eclipse of said coin sensor by said non-coin object;

said at least one coin-accept channel comprising a coin-guiding surface upstream from said lip to guide a coin past said lip toward said coin sensor; and, wherein said top surface of said lip is substantially horizontal.

2. The apparatus of claim 1 wherein said coin-guiding surface is a ramp; said ramp being spaced apart from said top surface, forming a void between the end of the ramp and the top surface of the lip.

3. The apparatus of claim 1, wherein said coin-guiding surface is arcuate.

4. The apparatus of claim 1 comprising a wall adjacent to said coin-accept channel, wherein said wall prevents said non-coin object from traveling downstream said lip and eclipsing said coin-sensor; said wall being substantially perpendicular to said lip and wherein a plane defined by an inner surface of the wall intersects the top surface of the lip.

5. The apparatus of claim 4, wherein said wall is an interior portion of a housing for said coin-accept channel.

6. The apparatus of claim 4, wherein said wall is attached to said coin-accept channel.

7. An apparatus comprising:

a housing;

a coin acceptor coupled to said housing to accept coins to operate said a coin-operated device, said coin acceptor comprising:

at least one coin-accept channel comprising a coin entrance portion and a coin exit portion downstream from said coin entrance portion, wherein said coin exit portion comprises a lip extending into the coin accept channel upstream from a coin sensor, said lip having a top surface substantially normal to a portion of the coin accept channel, wherein said lip obstructs passage of a non-coin object through the coin-accept channel to prevent the eclipse of said coin sensor by said non-coin object;

said at least one coin-accept channel comprising a coin-guiding surface upstream from said lip to guide a coin past said lip toward said coin sensor; and, wherein a downstream most portion of the coin-guiding surface is spaced apart from the top surface of the lip.

8. A coin-operated device, comprising:

a coin acceptor to accept coins to operate said coin-operated device, said coin acceptor compromising:

at least one coin-accept channel comprising a coin entrance portion and a coin exit portion downstream from said coin entrance portion, wherein said coin exit portion comprises a lip extending into the coin accept channel upstream from a coin sensor, said lip having a top surface substantially normal to a portion of the coin accept channel, wherein said lip obstructs passage of a non-coin object through the coin-accept channel to prevent the eclipse of said coin sensor by said non-coin object; and said at least one coin-accept channel comprising a coin-guiding surface upstream from said lip to guide a coin past said lip toward said coin sensor: wherein the coin-guiding surface extends into the coin accept channel less than the lip extends into the coin accept channel.

9. A method of preventing fraudulent receipt of credit for use of a coin-operated device, comprising:

a) guiding a coin received in a coin acceptor for a coin-operated device towards a coin sensor along a passage; wherein a portion of the passage upstream to the coin sensor is substantially vertical;

b) allowing the coin to drop vertically in the portion of the passage c) accelerating the coin in a direction normal to the coin face with a coin-guiding surface: such that the subsequent trajectory of the coin avoids a lip extending into the passage downstream from the coin-guiding surface; wherein the coin-guiding surface extends into the passage less than the lip;

d) detecting an eclipse of said coin sensor by said coin downstream from the lip;

e) detecting an opening of said coin sensor once said coin travels downstream from said com sensor;

f) crediting proper coinage for use of said coin-operated device once said coin sensor is eclipsed and subsequently opened; and g) blocking the introduction of a non-coin object to said coin-sensor with said lip.

10. The method according to claim 9, further comprising spacing the coin-guiding surface apart from the lip and providing a void between a downstream most portion of the coin-guiding surface and an upstream most portion of the lip.

* * * * *